United States Patent [19]

Newton et al.

[11] Patent Number: 4,672,713

[45] Date of Patent: Jun. 16, 1987

[54] SPRING COUPLER FOR BLOCK AND TACKLE WINDOW BALANCE SYSTEM

[75] Inventors: William P. Newton, Spencerport; Robert S. Flight, Rochester, both of N.Y.

[73] Assignee: Caldwell Manufacturing Company, Rochester, N.Y.

[21] Appl. No.: 892,371

[22] Filed: Aug. 4, 1986

Related U.S. Application Data

[63] Continuation-in-part of Ser. No. 810,564, Dec. 19, 1985, abandoned.

[51] Int. Cl.[4] ..... E05F 1/00

[52] U.S. Cl. ..... 16/197; 267/74; 267/179

[58] Field of Search ..... 16/197, 198, 199, 200, 16/201, DIG. 36; 267/179, 74, 61 R; 29/508; 49/445, 446, 430

[56] References Cited

U.S. PATENT DOCUMENTS

| | | | |
|---|---|---|---|
| 1,178,583 | 4/1916 | Hammet | 49/445 |
| 2,425,659 | 8/1947 | Viehweger | 16/197 |
| 2,588,432 | 3/1952 | Tomsche | 49/445 |
| 2,851,721 | 9/1958 | Decker | 16/197 |
| 2,885,725 | 5/1959 | Glass | 16/197 |
| 2,913,781 | 11/1959 | Czubachowski | 16/197 |
| 2,933,757 | 4/1960 | Almendinger | 16/197 |
| 3,021,578 | 2/1962 | Czubachowski | 16/197 |
| 3,034,170 | 5/1962 | Koebel | 16/197 |
| 3,064,306 | 11/1962 | Beasley | 16/197 |
| 3,116,520 | 1/1964 | Mac Gregor | 16/197 |
| 3,358,404 | 12/1967 | Dinsmore | 49/446 |
| 4,380,847 | 4/1983 | Tajima | 16/85 |

FOREIGN PATENT DOCUMENTS

| | | | |
|---|---|---|---|
| 78017 | 8/1919 | Austria | 267/74 |
| 88259 | 5/1958 | Netherlands | 16/197 |

*Primary Examiner*—Gene P. Crosby

*Attorney, Agent, or Firm*—Stonebraker, Shepard & Stephens

[57] ABSTRACT

A coupler connects end regions of different sizes of coiled tension springs 30 and 40 to components of block and tackle window balance systems 10. Each coupler 15, 20, or 25 has a snug fit within terminal coils 41 of the strongest spring 40 having the smallest inside diameter, and weaker spring 30 with a larger inside diameter has its terminal coils 31 necked down to fit the coupler. The coupler has a notch or opening with an abrupt edge 18, 22, or 28 axially spaced from an end of the coupler so that the notch is at least twice as long as the largest wire diameter used in the coil springs. At least one of the terminal coils of each spring is indented into the notch or opening in the coupler to a depth of more than one-half the wire diameter so that the indented coil interlocks with edge 18, 22, or 28 and keeps the spring from slipping off the coupler.

22 Claims, 9 Drawing Figures

SPRING COUPLER FOR BLOCK AND TACKLE WINDOW BALANCE SYSTEM

RELATED APPLICATIONS

This application is a continuation-in-part of pending allowed parent application Ser. No. 810,564, filed Dec. 19, 1985, now abandoned, entitled SPRING COUPLER FOR BLOCK AND TACKLE WINDOW BALANCE SYSTEM, which parent application is abandoned upon the filing of this continuation-in-part application.

BACKGROUND

We have discovered a better way of coupling a coiled tension spring to the components of a block and tackle window balance system. In this environment, spring couplers often fail under the large stresses they must withstand. The block and tackle spreads the spring force over a much longer distance than the spring is stretched, and the spring provides a much larger spring force that is reduced by the block and tackle as it is spread over the distance traveled by a window sash. The spring force exceeds the balance force applied to the sash by a factor of the number of working cord reaches in the block and tackle, and the couplers that connect the ends of the spring to the components of the block and tackle must withstand this large spring force.

Dinsmore U.S. Pat. No. 3,358,404 provides a good example of a block and tackle window balance system using a coiled tension spring. The block and tackle, with its pulleys and cord reaches, is confined in a channel along with the spring; and one of these assemblies is arranged at each side of each sash. The spring is tensioned between an anchorage fixed in the channel and a block and tackle that is movable within the channel. The spring stretches and contracts over a short distance under a large force that the block and tackle reduces and spreads over a longer working distance that the sash travels.

A popular way of coupling a coiled tension spring to components of a block and tackle window balance system has been to bend hooks in the terminal coils at each end of the spring. These bends weaken the terminal coils so that the spring is likely to fail by breaking off one of its end hooks. Alternative spring couplings have included coiling a spring tightly around a cylinder, threading a connector into the end coils of a spring so that the pitch of the thread matches the pitch of the end coils, and bending spring ends to form pins inserted into retainer holes. Any sharp bend in a spring end weakens the spring at that point and is unsatisfactory, and spring grips on cylinders or threaded connectors have required a different coupler for each size of spring and have been too weak to withstand the spring force of a block and tackle balance system.

Decker U.S. Pat. No. 2,851,721 on a window balance system suggested that the sheath surrounding a spring operating in both torsion and tension be dented inward to force coils of the spring into a window in a hollow holder tube. Then the discontinuities in the sheath, the dented spring coils, and the holder tube would help retain the spring against axial movement. Our spring coupler also indents spring coils into an opening in a hollow tube; but it does not involve a surrounding sheath, does not apply to a spring working partially in torsion, and does not lack the strength to resist the high tension forces exerted by block and tackle window balance springs.

SUMMARY OF THE INVENTION

A single size of our coupler can work with several different sizes of springs made of different diameter wire and having different inside diameters. Because the springs of block and tackle window balance systems are preferably contained within a channel that limits their outside diameter, the preferred way of making springs with different forces is to hold all the outside diameters constant and use different sizes of spring wire, which changes the inside diameters and the pitch of the spring coils. We have found that a single size coupler tube can be formed to fit within the smallest inside diameter of a range of spring sizes, and the spring coils with larger inside diameters can easily be made to fit the coupler tube by necking down their terminal coils. We have also found that necked-down terminal coils are inherently stronger so that weak spots are not created where spring coils are indented into the coupler tube.

In working with different diameters of spring wire and different inside diameters of coiled tension springs, we have also discovered basic relationships that must be observed in forming an abrupt edge of an opening or notch and interlocking an indented spring coil with that edge. All of our discoveries cooperate to provide a simple, inexpensive, and highly reliable coupler for the ends of a coiled tension spring in a block and tackle window balance system.

DRAWINGS

DETAILED DESCRIPTION

Figure 1:
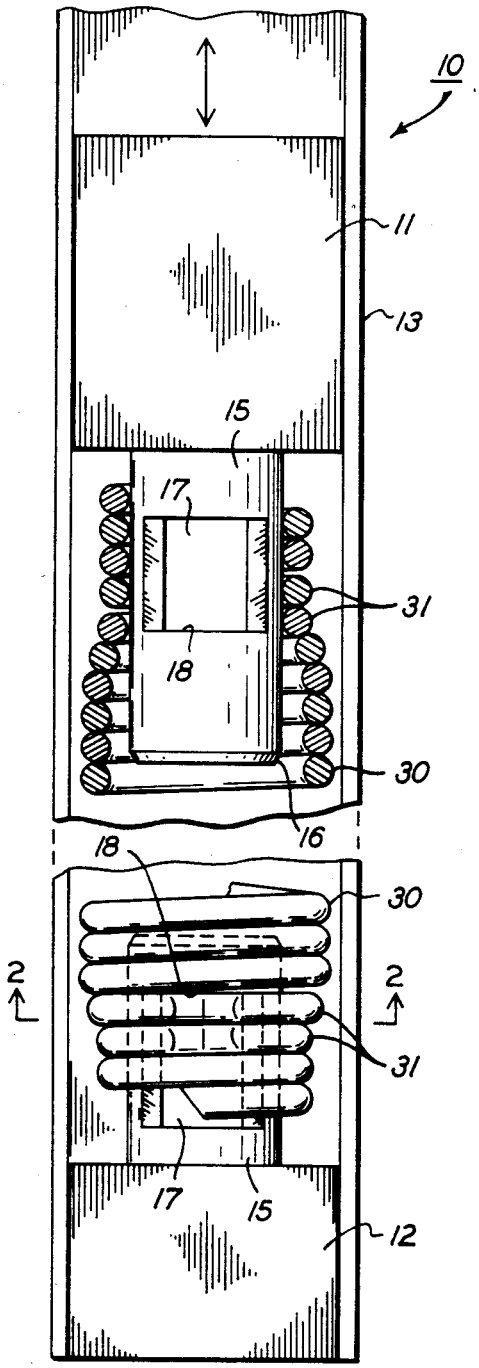
FIG. 1 is a partially schematic, front elevational view of a preferred embodiment of our spring coupler arranged in a schematically illustrated block and tackle window balance system and connected to a spring having a minimum wire diameter.

The drawings concentrate on our coupler and its interaction with coiled tension springs and only schematically illustrate the known and well-understood environment of a block and tackle window balance system 10, which includes a movable block and tackle 11 and a fixed anchorage 12 arranged within a channel 13. In the embodiments of FIGS. 1–5, similar coupler tubes 15 are connected respectively with movable block and tackle 11 and fixed anchorage 12 for interlocking with coiled tension springs 30 and 40. In the embodiments of FIGS. 6–9, coupler shapes other than tubular are similarly connected with coiled tension spring 30.

Each coupler tube 15, in the embodiments of FIGS. 1–5, is formed as a hollow tube having a preferably beveled end 16 for sliding into end coils of a spring. Each tube 15 has a recess or opening 17 with an abrupt edge 18 facing away from beveled end 16 and oriented to interlock with a spring coil and resist spring force tending to pull the spring off of coupler tube 15. Edge 18 is preferably perpendicular to the axis of tube 15 and extends radially along a circumference of tube 15 for a distance at least twice as long as the maximum diameter of spring wire to be used in springs coupled to tube 15. This provides an adequate length for indenting a coil of a spring into opening 17 to a sufficient depth so that more than one-half the diameter of the wire of the indented coil interlocks with abrupt edge 18. Opening 17 also preferably extends axially far enough so that two coils of a spring can be indented into opening 17 for jointly interlocking with edge 18. We have found that a single indented spring coil interlocking with edge 18 is adequate to make the coupling strong and reliable, but we prefer indenting two spring coils into opening 17 for added strength and security.

Figure 3:
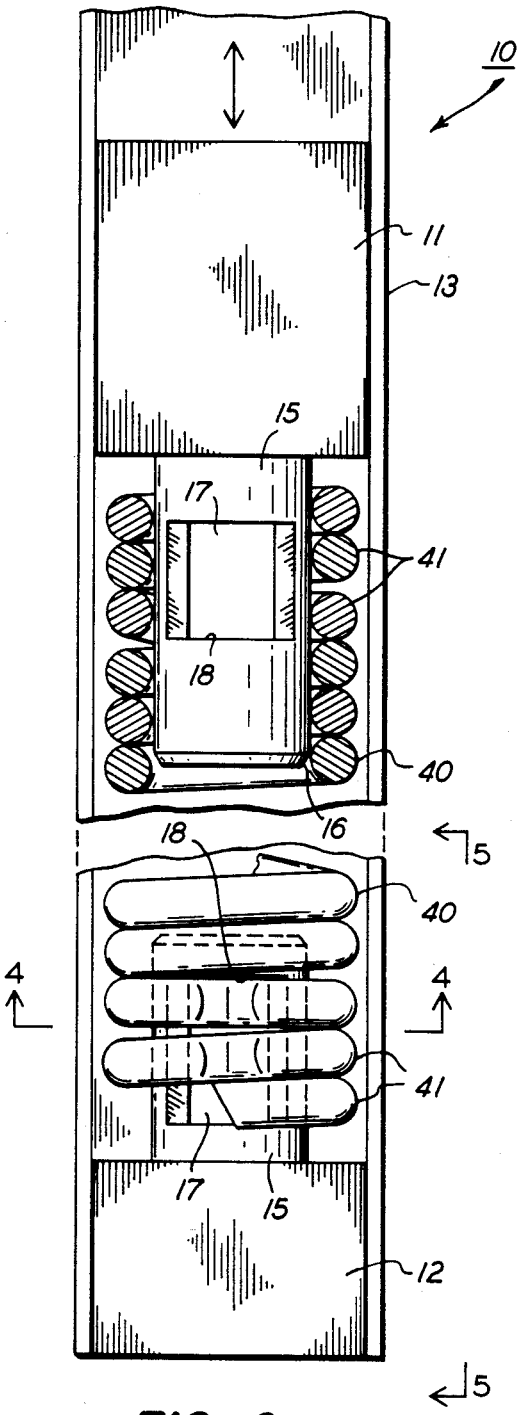
FIG. 3 is a partially schematic, front elevational view, similar to the view of FIG. 1, and showing our spring coupler connected to a spring having a maximum wire diameter.

Spring coils 30 and 40 of FIGS. 1 and 3 have the same maximum outside diameter that is set to fit loosely within channel 13; but spring 30 has a minimum spring force and uses a minimum diameter wire, while spring 40 has a maximum spring force and uses a maximum diameter wire. A range of spring sizes can lie between springs 30 and 40—all having the same outside diameter and all using different diameter spring wire. The spring coils of such a range of spring sizes have different inside diameters that are all accommodated to coupler tubes 15.

The smallest inside diameter spring coil occurs in the strongest spring 40 using the largest diameter spring wire, and we size coupler tubes 15 to fit snuggly within the coils of spring 40. We make the weaker springs with larger inside diameters fit snuggly onto coupler tubes 15 by necking down their terminal coils, as shown for terminal coils 31 of spring 30. The necking down of terminal end coils is easily accomplished when the springs are wound, and all necked-down terminal coils of a full range of spring sizes are easily given the same inside diameter for fitting snuggly over coupler tubes 15. Necked-down terminal coils are also inherently stronger than larger coils of the same spring so that the interlock with edge 18 is strengthened by necking down the spring coils that are indented into opening 17. Terminal coils 41 of the largest spring 40 are not necked down, but these are also exceptionally strong from being formed of maximum diameter wire.

Figure 2:
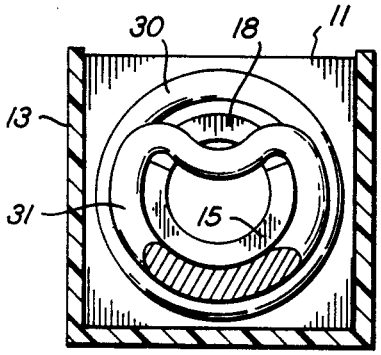
FIG. 2 is a cross-sectional view of the spring coupler of FIG. 1, taken along the line 2—2 thereof.
Figure 4:
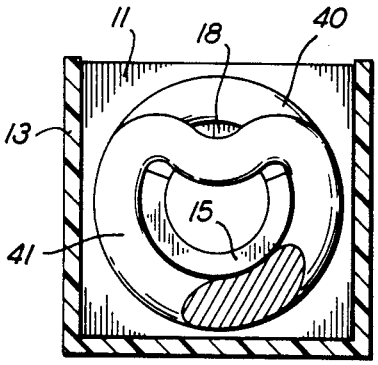
FIG. 4 is a cross-sectional view of the spring coupler of FIG. 3, taken along the line 4—4 thereof.

FIGS. 2 and 4 show the indented terminal coils 31 and 41 that interlock with edges 18 of coupler tube 15. The indentation of each coil is sufficient to force more than one-half the wire diameter within the outermost point of interlocking edge 18.

Figure 5:
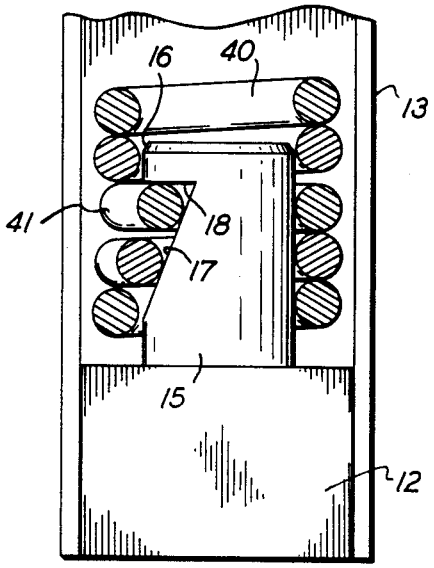
FIG. 5 is a fragmentary, side elevational view of an alternative way of forming an opening adjacent an interlocking edge of a coupler tube according to our invention.
Figure 6:
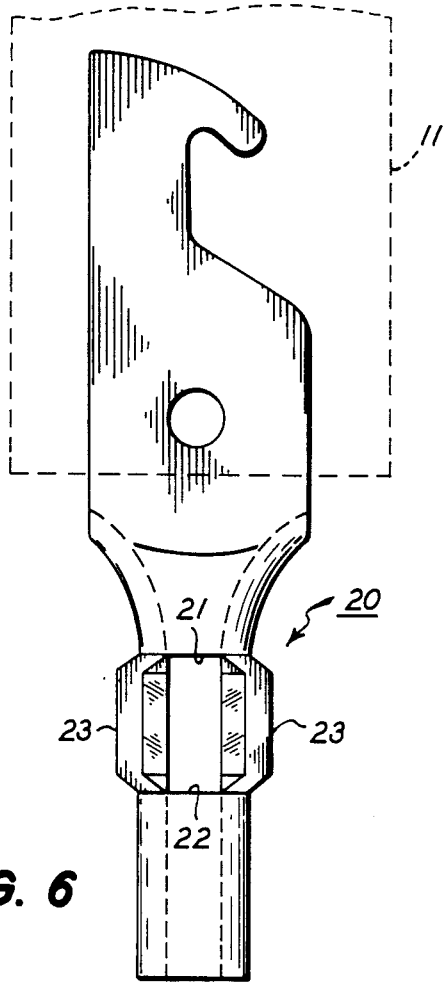
FIG. 6 is a plan view of an alternative preferred embodiment of our spring coupler.
Figure 7:
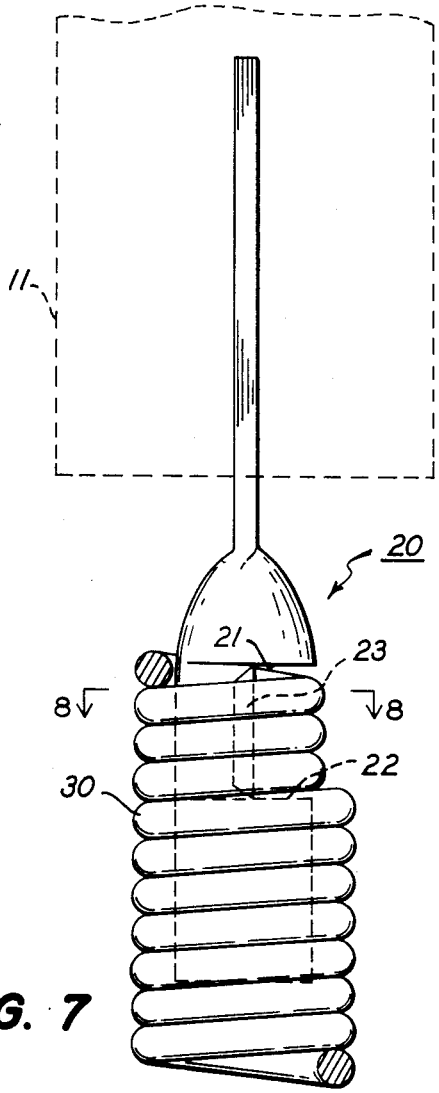
FIG. 7 is a side elevational view of the coupler of FIG. 6 connected to a spring.

As shown in FIG. 5, abrupt edge 18 of coupler tube 15 can be formed by stamping opening 17 as a recess dented inward from the periphery of tube 15. FIG. 5 also shows a side view of how indented spring coils 41 interlock with edge 18 to hold spring 40 securely on tube 15.

Figure 8:
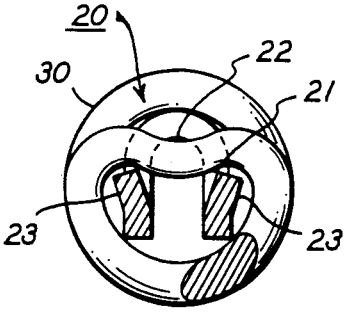
FIG. 8 is a cross-sectional view of the coupler and spring of FIG. 7, taken along the line 8—8 thereof.

We have also found that couplers can succeed with shapes other than tubular and with openings or notches formed in other ways, as shown in FIGS. 6–9. Our preferred coupler 20 is U-shaped in cross section, as best shown in FIG. 8, and has a notch 21 forming edge 22 at a semi-cylindrical portion of the U-shape. In the region of notch 21, the side legs of the U-shape are flared outward to form wings 23. The space available within notch 21 is at least as wide as twice the diameter of the spring wire in a direction transverse to edge 22 to allow ample room for indenting a spring coil into an interlock with edge 22 as shown in FIG. 8. The U-shaped form of coupler 20 can succeed as well as tubular coupler 15, because the notch region of coupler 20 is unable to rotate within the indented coil of spring 30. If this were possible, edge 22 could rotate clear of the indented spring coil and allow coupler 20 to slide out of the end of spring 30. Flared out wings 23 in notch 21 prevent any such rotation so that edge 22 is reliably interlocked with the indented spring coil.

Figure 9:
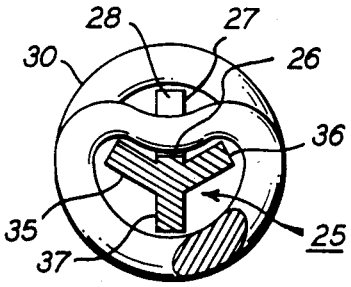
FIG. 9 is a cross-sectional view, similar to the view of FIG. 8, and showing an alternative shape of coupler.

Coupler 25 of FIG. 9, although having a different form, embodies similar principles. Coupler 25 is approximately X- or cross-shaped in cross section and has a notch 26 in arm 27 providing an edge 28 that interlocks with an indented coil of spring 30. The transverse space available across edge 28 is at least twice the diameter of spring 30 to allow ample room for a gentle inward bend of the indented coil. Side arms 35 and 36 cooperate with notched arm 27 and base arm 37 to prevent rotation of coupler 25 within the indented spring coil so that edge 28 is reliably interlocked with spring 30.

Suitable couplers for practicing our invention also must have an axial length sufficient to prevent axial skewing of the coupler through a sufficient angle to cooperate with a small rotation and release the notch edge from the interlock with the indented spring coil. So long as axial skewing and rotation are sufficiently limited in the notch region of the coupler and the other conditions of this invention are observed, the coupling remains reliably connected and adequately strong to be both effective and economical.

We claim:

1. A coupler for connecting end regions of different sizes of coiled tension springs to components of block and tackle window balance systems, said different sizes of coiled tension springs supplying different spring forces, each larger than a respective system balance force by a factor of the number of working cord reaches in the block and tackle, said coupler comprising:

a. a hollow tube having a snug fit within terminal coils of the smallest inside diameter of said sizes of coiled tension springs, other sizes of said coiled tension springs with larger inside diameters having said terminal coils necked-down to fit said tube;

b. a wall of said tube having an opening with an abrupt edge axially spaced from an end of said tube, said edge being at least twice as long as the largest wire diameter used in said sizes of coiled tension springs; and c. one of said coiled tension springs being connected with said tube by having at least one of said terminal coils of said connected spring indented into said opening to a depth of more than one-half the wire diameter of said connected spring so that said indented coil interlocks with said edge and keeps said connected spring from slipping off said tube.

2. The coupler of claim 1 wherein two of said terminal coils of said connected spring are indented into said opening.

3. The coupler of claim 1 wherein said different sizes of coiled tension springs have substantially equal outside diameters and different wire diameters forming different inside diameters.

4. The coupler of claim 3 wherein two of said terminal coils of said connected spring are indented into said coupler opening.

5. A method of coupling end regions of coiled tension springs to components of block and tackle window balance systems, said coiled tension springs varying in spring force that each exceeds a respective system balance force by a factor of the number of working cord reaches in the block and tackle, said method comprising:

a. varying the diameter of wire in said coiled tension springs to vary the spring force of said springs and forming the terminal coils of a plurality of sizes of said springs with substantially equal inside diameters by necking down said terminal coils of springs having larger than minimum inside diameters;

b. using single size coupler tubes having a snug fit within said terminal coils of said plurality of spring sizes, each of said coupler tubes being connected with a component of said block and tackle balance system;

c. forming an opening in a wall of each of said coupler tubes so that said opening has an abrupt edge at least as long as two times the largest wire diameter used in said springs, said edge being oriented to oppose the tension force of said springs; and d. indenting at least one of said terminal coils of each of said springs into one of said openings by more than one-half the diameter of the respective spring wire so that the indented coil interlocks with said edge to connect said spring and said coupling with a tension resistance exceeding the force of said spring.

6. The method of claim 5 including indenting two of said terminal coils of each of said springs into each one of said openings.

7. The method of claim 5 including making the outside diameters of said plurality of sizes of said springs substantially equal.

8. The method of claim 7 including indenting two of said terminal coils of each of said springs into each one of said openings.

9. A connector between end regions of different sizes of coiled tension springs and components of block and tackle window balance systems, said different sizes of coiled tension springs supplying different spring forces, each larger than a respective system balance force by a factor of the number of working cord reaches in the block and tackle, said connector comprising:

a. a coupler slidable axially into the terminal coils of the smallest inside diameter of said sizes of coiled tension springs, other sizes of said coiled tension springs with larger inside diameters having said terminal coils necked-down to fit said coupler;

b. said coupler having a notch with an abrupt edge axially spaced from and facing away from an inner end of said coupler, space within said notch transverse to said edge being at least twice as long as the largest wire diameter used in said sizes of coiled tension springs;

c. one of said coiled tension springs being connected with said coupler by having at least one of said terminal coils of said connected spring indented into said notch to a depth of more than one-half the wire diameter of said connected spring so that the indented spring coil interlocks with said edge to block said coupler from withdrawing from said connected spring; and d. said coupler, in the region of said notch, having a shape that prevents said coupler from rotating within said indented spring coil so that said edge cannot rotate clear of the interlock with said indented spring coil and allow said connected spring to slip off said coupler.

10. The connector of claim 9 wherein two of said terminal coils of said connected spring are indented into said notch.

11. The connector of claim 9 wherein said different sizes of coiled tension springs have substantially equal outside diameters and different wire diameters forming different inside diameters.

12. The connector of claim 11 wherein two of said terminal coils of said connected spring are indented into said coupler notch.

13. The connector of claim 9 wherein said coupler is U-shaped in cross section.

14. The connector of claim 13 wherein said notch is formed in the semicircular region of said U-shape.

15. The connector of claim 14 wherein a notch region of said coupler has wings flaring outward from the sides of said U-shape.

16. A method of coupling end regions of coiled tension springs to components of block and tackle window balance systems, said coiled tension springs varying in spring force that each exceeds a respective system balance force by a factor of the number of working cord reaches in the block and tackle, said method comprising:

a. varying the diameter of wire in said coiled tension springs to vary the spring force of said springs and forming the terminal coils of a plurality of sizes of said springs with substantially equal inside diameters by necking down said terminal coils of springs having larger than minimum inside diameters;

b. using single size couplers axially slidable within said terminal coils of said plurality of spring sizes, each of said couplers being connected with a component of said block and tackle balance system;

c. forming a notch in each of said couplers so that said notch has an abrupt edge oriented to oppose the tension force of said springs, space within said notch transverse to said edge being at least as long as two times the largest wire diameter used in said springs; and d. indenting at least one of said terminal coils of each of said springs into one of said notches by more than one-half the diameter of the respective spring wire so that the indented coil interlocks with said edge and the notch region of said coupler is prevented from rotating within said indented coil so that said edge cannot rotate clear of said interlock with said indented coil.

17. The method of claim 16 including indenting two of said terminal coils of each of said springs into each one of said notches.

18. The method of claim 16 including making the outside diameters of said plurality of sizes of said springs substantially equal.

19. The method of claim 18 including indenting two of said terminal coils of each of said springs into each one of said notches.

20. The method of claim 16 including forming said coupler as U-shaped in cross section.

21. The method of claim 20 including forming said notch in the semicircular region of said U-shape.

22. The method of claim 21 including forming a notch region of said coupler with wings flaring outward from the sides of said U-shape.

* * * * *